United States Patent [19]

Ehlers

[11] Patent Number: 4,718,654

[45] Date of Patent: Jan. 12, 1988

[54] APPARATUS AND METHOD FOR SEPARATION AND DELIVERY OF CONTINUOUS FORMS

[75] Inventor: Dennis W. Ehlers, Green Bay, Wis.

[73] Assignee: Paper Converting Machine Company, Green Bay, Wis.

[21] Appl. No.: 855,132

[22] Filed: Apr. 22, 1986

Related U.S. Application Data

[63] Continuation-in-part of Ser. No. 833,236, Feb. 27, 1986, abandoned.

[51] Int. Cl.[4] ..... B65H 41/00

[52] U.S. Cl. ..... 270/52.5; 270/39; 493/357; 493/411; 493/400; 225/103; 225/2; 225/4; 225/32

[58] Field of Search ..... 270/40, 39, 41, 52, 270/52.5, 47, 21.1; 493/357, 360, 411–413, 414, 361–363, 430, 424, 379–381, 390, 398; 225/99–106, 1–5, 32, 33; 400/613.2, 621; 83/925 R, 512, 648, 563, 519; 215/400–401, 93, 97–98, 100–101, 103–105

[56] References Cited

U.S. PATENT DOCUMENTS

| | | | |
|---|---|---|---|
| 2,761,677 | 9/1956 | Rutkus et al. | 270/39 |
| 3,163,413 | 12/1964 | Franke et al. | 270/39 |
| 3,858,476 | 1/1975 | Deligt | 83/512 |
| 4,205,836 | 6/1980 | Nystrand | 493/357 |
| 4,401,428 | 8/1983 | Thomas et al. | 493/411 |
| 4,508,527 | 4/1985 | Uno et al. | 225/103 |
| 4,618,340 | 10/1986 | Meschi | 493/357 |

FOREIGN PATENT DOCUMENTS

| | | | |
|---|---|---|---|
| 159717 | 10/1985 | European Pat. Off. | 270/52.5 |

*Primary Examiner*—E. H. Eickholt

*Attorney, Agent, or Firm*—Tilton, Fallon, Lungmus & Chestnut

[57] ABSTRACT

A device for zig-zag folding a series of web segments connected at transverse lines of perforation and for separating a pre-determined series of the web segments into stacks having co-acting folding rolls adapted to deliver a zig-zag folded web, a pair of opposed cantilevered plates movably mounted adjacent the folding rolls to provide alternative support for a developing stack and to prevent concavity, and means for moving the plates.

8 Claims, 5 Drawing Figures

FIG. 1
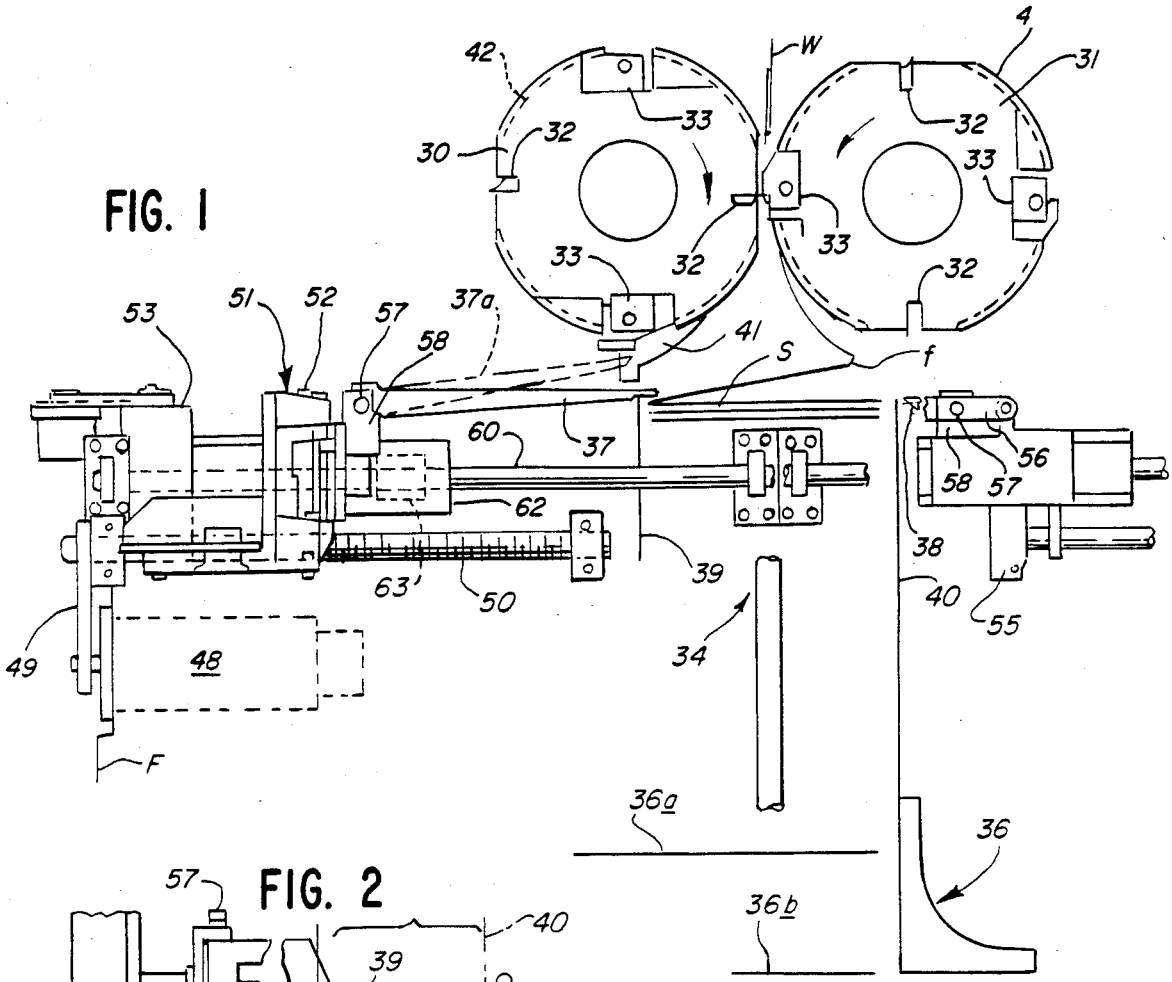
FIG. 2
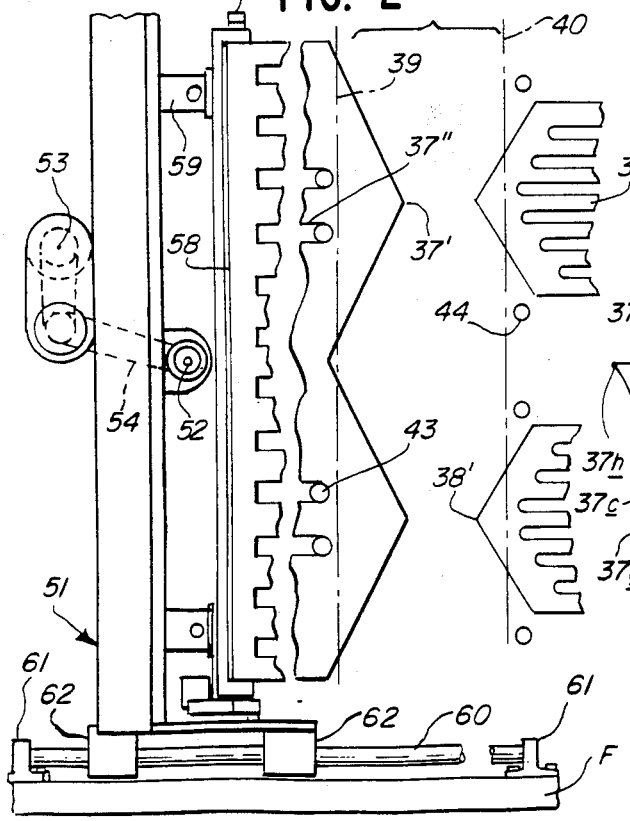
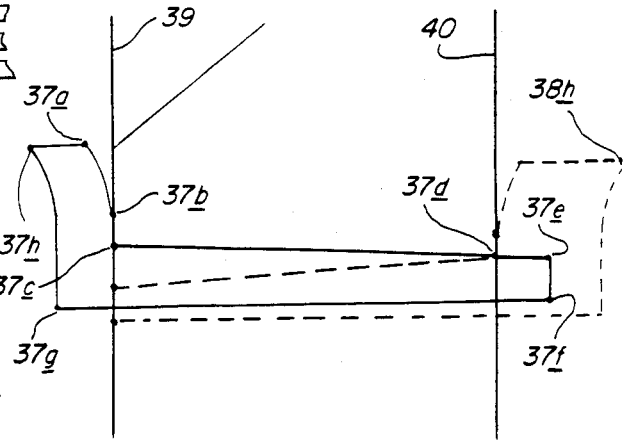
FIG. 3

APPARATUS AND METHOD FOR SEPARATION AND DELIVERY OF CONTINUOUS FORMS

This application is a continuation-in-part of my copending application Ser. No. 833,236, filed Feb. 27, 1986 now abandoned.

BACKGROUND AND SUMMARY OF INVENTION

This invention relates to apparatus for separation and delivery of continuous forms and, more particularly, for providing discrete stacks of single sheet zig-zag folded forms suitable for computer use.

In recent years, the market for business forms made from single webs has been increasing—generally at the expense of multiple copy forms which can include two or more webs with interleaved carbon sheets. Much of this is attributable to the growth in computer print-outs available therefrom. Most of the "singles" forms are perforated along the edge with a margin on each side having line holes punched therein in order to guide them through the forms making machine and in final use, through the computer printers, etc. There has been rapid growth in single web forms usage in the past few years due to printouts or reports from large high speed computers which process information rapidly and have a high rate of usage for connected forms. Frequently, 4,000 forms are connected together forming a stack approximately 16" high. More recently, with the advent of desk-top business and personal computers, it is desirable to have fewer forms connected for smaller volume usage and broader sales distribution.

Current practice in the manufacturing of forms involves table top delivery of connected forms at a separating line. The still connected group of up to 4,000 forms are then pushed over the rounded edge of the discharge table into an empty carton and are then pushed manually on a carrying conveyor for subsequent closing and stacking, etc. In short, present systems involve manual separation between counts and considerable handling of forms for subsequent accumulation and packaging, etc. Forms handling is done by the machine operators who are thus occupied at the delivery end when they would be more gainfully involved in adjustments and quality control upstream.

Heretofore, and especially with short count stacks containing as few as 100 or 200 forms, there has not been suitable and practical means for separating and delivering these short count stacks.

Solution of this problem has been frustrated by the lack of a suitable separating device. Earlier, there were attempts to develop proper machinery for web separation at count, and apparatus similar to the "burster" shown in co-owned U.S. Pat. No. 4,131,272 proved to be effective. However, the free leading edge of a subsequent stack proved to be a vexing problem since it was not exactly controlled and directed once separation occurred.

Conceptually similar to the instant invention is co-owned U.S. Pat. No. 3,301,111 which shows a system for achieving count separation between long count stacks, although this system requires manual operation as well as manual severing of the perforation between stacks. This prior art not only required handling of separate "pans" to support the substack between two descending elevators positioned at the sides of the discharge path, but it required a considerable degree of attention by the operator and was not as effective as the current mode of operation described above.

The U.S. Pat. No. 3,301,111 was adequate for previous marketing and distribution parameters which included long-count stacks for large computers—but more recent requirements for short count stacks and the potential for less operator handling and attention could not be satisfied.

According to the instant invention, movable plates are inserted into the developing stack to divide the same into proper "counts", with one of the plates being arranged to sever the zig-zag folded stream into discrete stacks. The plates are so operated to prevent disadvantageous concavity in the developing stacks. Other details and advantages of the invention can be seen in the ensuing description.

The invention is described in conjunction with an illustrative embodiment in the accompanying drawing in which FIG. 1 is a fragmentary side elevational view of apparatus embodying teachings of the instant invention;

FIG. 2 is a fragmentary top plan view of one of the separator plates with some associated mechanism;

FIG. 3 is a diagram of movement of the end of the separator plate of FIG. 2;

DETAILED DESCRIPTION

Figure 4:
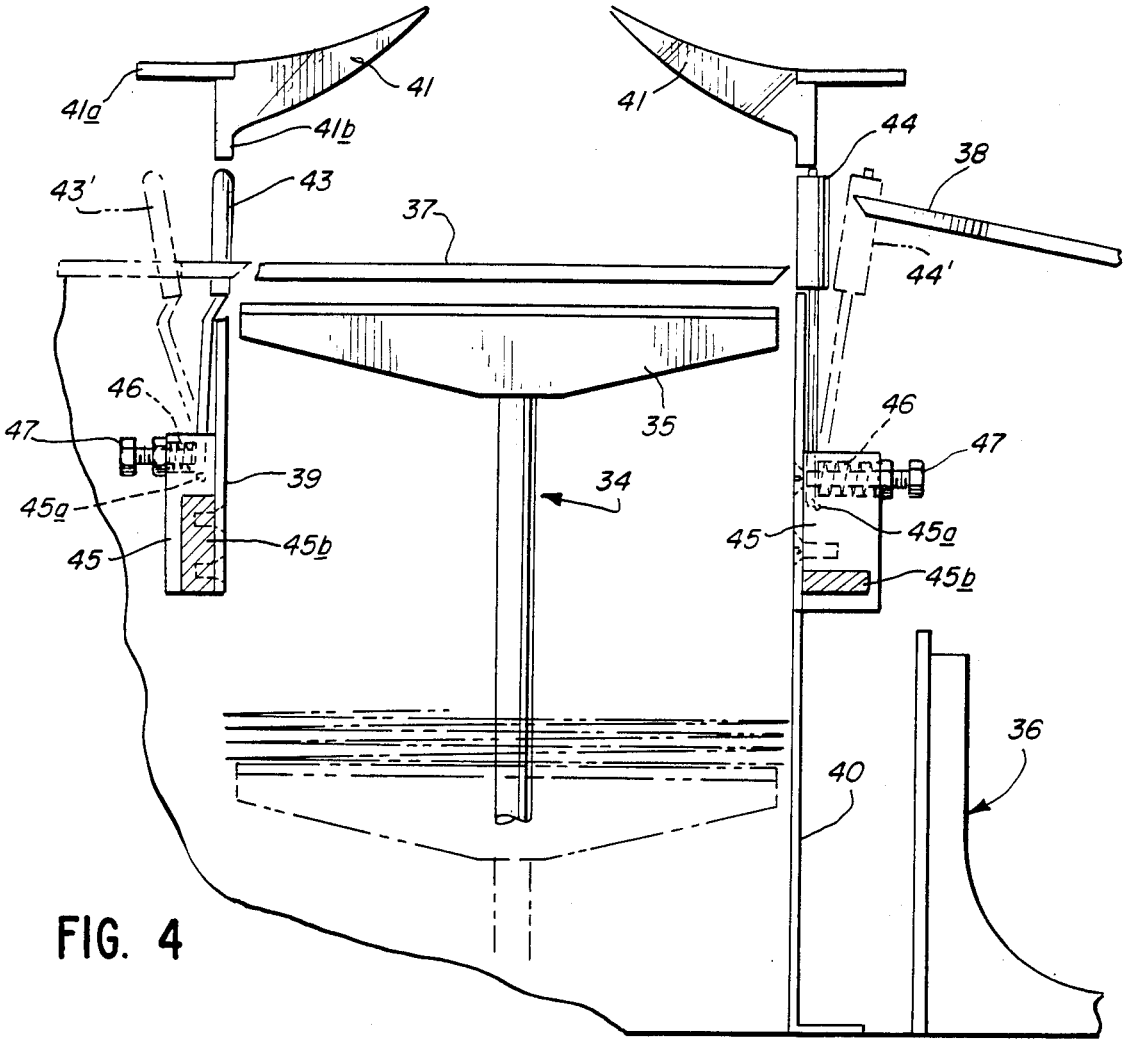
FIG. 4 is a fragmentary side elevational view of details of the apparatus shown only fragmentarily in FIG. 1.

In the illustration given and with reference first to FIG. 1, the symbol W designates a web which is shown approaching the nip between folding rolls 30 and 31 supported on a frame F. For ease of understanding, the environmental frames, support, unwind, etc. have been omitted. These are conventional and well established in the art. Further, the web W is continuous but has transverse lines of perforation, usually at a spacing of 8½" or 11". The sheets or panels so defined are developed by the apparatus running at a speed of the order of about 1500' per minute or between 25 and 35 panels per second.

The folding rolls 30, 31 are identical, each being equipped with a pair of tuckers 32 and a pair of grippers 33. The folding rolls 30, 31 are oriented 90° out of phase so that the tucker 32 of one roll co-acts with the gripper 33 of the other roll to develop a transverse fold along the line of perforation previously referred to. This results in the conventional zig-zag or accordion folding.

The folding rolls 30, 31 are provided on the frame F, being carried in suitable bearings and equipped with gears for co-acting rotation.

Ultimately, a series of "short count" stacks are delivered to a vertically reciprocable elevator generally designated 34 and carrying a receiving platform 35 (see FIG. 4)—the elevator 34 also being carried by the frame and powered in a manner to be described hereinafter. Also provided on the frame is a horizontally reciprocable pusher generally designated 36 (see the lower right-hand portion of FIG. 1) which transfers pre-determined count stacks from the platform 35 to a conveyor (not shown). This can be done either at the level **36*a* or the level 36*b***.

For achieving the separation a movable plate 37 is provided on the frame, the plate 37 being seen in top plan view in FIG. 2 with its entering edge being angled to a point as at 37'. The plate 37 provides both the support and the separation (when required) for the zig-zag folded product, ultimately delivering the same to the platform 35 of the elevator 34.

At the instant of time depicted in FIG. 1, a previous stack S has been accumulated—consisting of 200 count or panels—which is carried by the elevator platform 35. The web W is seen to have a fold F developed therein which ultimately will provide the line of severance and thereby earmarking the end of the 200 count stack S and the beginning of the next stack to be accumulated. It will be appreciated that all of this is accomplished in very short time—of the order of 5 to 10 seconds per 200 count stack.

As a stack is being developed, the phenomenon of "concavity" appears. This is present in every zig-zag folded stack because the folds occupy more vertical space than the center of the pack of forms. This adverse phenomenon is overcome according to the invention through the provision of a second movable plate which is shown only fragmentarily as at 38 in the extreme right-hand portion of FIG. 1 but in more detail in FIG. 4. The plate 38 is employed usually halfway through the cycle to support a stack in its process of development, viz., after 100 count so that the concavity phenomenon is minimized. This then permits the severing plate 37 to pass by panels with minimal concavity in the lower panel and thereby avoid any problem of impalement, jamming, etc. Again, it will be appreciated that these movements are extraordinarily fast so undue concavity could result in jamming the apparatus.

OPERATION GENERALLY

Reference is now made to FIG. 3 which is a diagram showing the movement of the tips of the two plates 37 and 38. In the diagram in FIG. 3, the position designated 37*a* corresponds to the position of the edge points 37'., viz., the tips of the plate 37 when the plate is in the dotted line position designated 37*a* in FIG. 1.

In the illustration given, there are two tips 37' on the plate 37—one for each of the two stacks being developed simultaneously. The solid line showing of the plate 37 in FIG. 1 has a tip position corresponding to that designated 37*b* in FIG. 3. In proceeding from position 37*a* to position 37*b*, the plate 37 is pivoted through a downward arc while being simultaneously moved inwardly so as to overlap panels in the stack S, i.e., project inwardly of the left hand guide 39 (again see FIG. 1). The pivotal movement insures that the plate edge moves in synchronism with the drape of the web W during the folding which can be seen just above the fold fin FIG. 1. This all occurs rapidly—in less than the time it takes to form one panel or segment by folding.

The edge of the plate 37 remains at the illustrated inward penetration for a portion of the cycle to accommodate a slight build-up of panels thereabove. For example, the edge 37' does not move inwardly in moving from position 37*b* to position 37*c*. However, during that portion of the cycle, amounting to approximately 25 panels, the plate 37 moves downwardly to accommodate the developing stack. This development of a partial stack of about 25 panels insures that the developing stack has integrity and substance before the plate 37 begins its further inward movement—as from 37*c* to 37*e*. In other words, if only one or a few panels were stacked on top of the plate and the plate would move immediately to the right, the paper panels on top of the plate are not sufficiently rigid to withstand buckling or wrinkling and they would tend to move to the right along with the plate 37. Hence partial stack build-up occurs before the plate 37 moves from position 37*c* to position 37*e*. This movement is very rapid as can be appreciated from the fact that this occurs over the deposit of only one or two panels. During this portion of the cycle, the plate 37 is descending, again to accommodate stack build-up.

The movement of plate 37 to the position 37*e* results in severance of the web along a fold on a line of perforation. This demarks the end of one stack and the beginning of the next stack. Plate 37 remains in this extended position for a period of time while descending to the position 37*f*. During this period of time the elevator 34 has descended, the pusher 36 had removed the completed stack from platform 35 and the elevator 34 has returned to a raised position to support the now-developing stack when the plate is removed from the stack path—as by moving to the position 37*g*. At this point in time and space, the tip 37' of the plate 37 is external of the left-hand guide 39 (compare FIGS. 1 and 3). The plate then moves upwardly and still further outwardly to the position 37*h* where it is now in readiness to commence another cycle—compare the location of plate 38 at 38*h*.

Still referring to FIG. 3, reference is now made to the dashed line showing which represents the path or profile of the leading edge of the plate 38. The plate 38 is not equipped with a serrated edge because it operates, as explained previously, to support a developing stack to prevent disadvantageous concavity. Further, it will be seen that the furthest movement to the left in FIG. 3 is still short of the guide 39—as contrasted to the greater displacement of the blade 37. On the other hand, the dashed line shows a greater retraction, viz., displacement to the right upon return to starting position as at 38*h*, so as to avoid any possible interference with the blade 37.

In a 200 count stack, the plate 37 supports the first portion of the stack—up to 100 panels depending upon the time needed for the elevator 34 and pusher 36 to perform their functions as described above. It will be appreciated that the first portion supported by the plate 37 could be less than 100 panels depending upon the speed of the removal operation.

The plate 38, in a 200 count stack supports the 101st to 200th panels. As the 200th panel descends, the plate 37 moves again from position 37*a* to position 37*b* to demark another stack—and the movement from 37*b* through 37*c* to 37*e* is repeated.

When, however, a larger count stack is required—say 4,000 panels—the plate 37 does not move all the way to position 37*e* but stops at position 37*d*. In such a case, the plate 37 is performing just like plate 38—providing a support but not a severing function. With the 4,000 count stack, the plate 37 moves to the position 37*d* for 19 cycles of operation. Then on the 20th cycle, it moves to the position 37*e*. So the invention provides a sequence of substack supports at 100 count intervals.

Stripping and Guide Means

Figure 5:
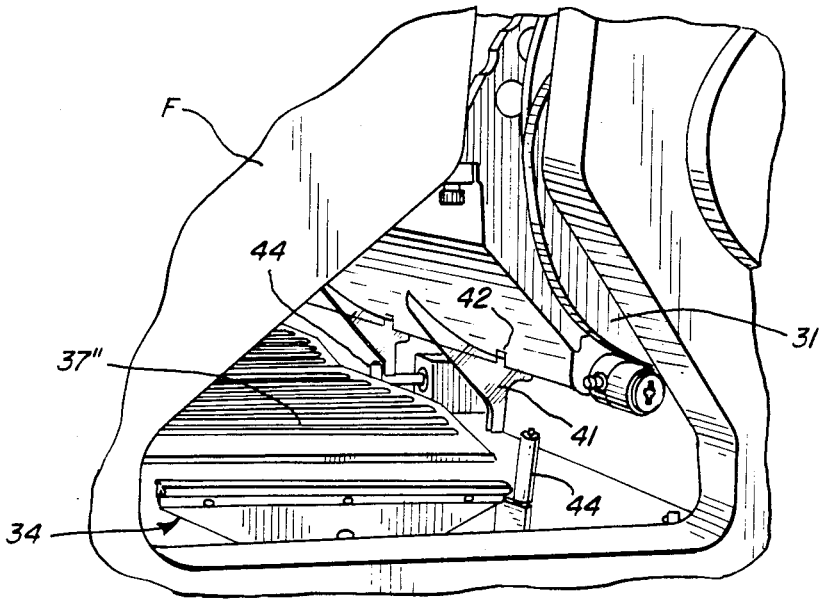
FIG. 5 is a fragmentary perspective view of the apparatus portion of FIG. 4.

To initially strip the partially folded web from the rolls 30 and 31, I provide stripper arms 41 (see the upper portion of FIG. 4 and the lower central portion of (FIG. 5). These are mounted on the frame F on cross bars 41*a* and are positioned within slots 42 of the rolls 30 and 31. Advantageously, the arms 41 are constructed of transparent plastic—therefore the slots 42 can be seen in roll 31 of FIG. 5. The bottom projections 41*b* on the arms 41 are in line with the respective guides 39 and 40 and initially define the chute or path in which the stack is formed.

Aligned with the projections 41*b* (referring now to FIG. 4) are stripper rods 43 for the left guide 39 and 44 for the right guide 40. Each rod is mounted in similar fashion—being pivotally mounted as at 45*a* in a block 45 fixed to the frame by cross spacers 45*b*. These cross spacers also carry the guides 39 and 40.

Each stripper rod is spring biased toward the vertical position by a spring 46 mounted in the associated block 45 and the spring is suitably compressed by an adjusting screw 47.

The rods 43 extend through slots 37″ in the plate 37 and can pivot to the dotted line position 43′ (see FIG. 4) when the plate 37 is retracted—as in the 37*g* or 37*h* positions. The pivotal mounting of the rods 44—permitting pivoting to the dotted line position 44′ is to allow the plate 37 to move fully to the right. In severing the web at a fold, the tips 37′ of the plate 37 penetrate the web and by a progressive cutting action—due to the angled edges—complete the cut. As can be appreciated from FIG. 3, this requires the plate 37 to pass well to the right of the guide 40.

Inasmuch as the plates 38 perform no cutting action, they can be spaced to permit installation of the rods 44. However, the plates 38 are beveled to a point as at 38′ to facilitate insertion. They may also be equipped with slots as seen in FIG. 2 to cut down on friction.

The rods 43 and 44 perform an additional function in continuing the definition of the receiving chute or path right at the point of plate insertion so as to avoid any unwanted unfolding due to static in the webs.

The guides 39 and 40 are a series of spaced vertically extending bars mounted on the frame cross spacers 45*b*. This permits the pusher 36 to pass therethrough and the guide 39 does not extend vertically downwardly as far as the guide 40 so as not to interfere with stack removal.

Mechanisms are provided to develop the vertical, horizontal and pivotal movement of the plates 37 and 38. Inasmuch as these are substantially identical, only the mechanism depicted in connection with plate 37 will be described.

Horizontal Displacement Mechanism

The horizontal movement of the plate 37 is actuated by a servo motor 48—see the lower left hand portion of FIG. 1. This is supported on the portion of the frame F. A suitable programmable control for servo motor 48 is Model MSC-800 manufactured by Industrial Indexing Systems. The motor is coupled by means of a belt drive 49 to a screw 50.

Still referring to FIG. 1 and in the central left hand portion thereof, the numeral 51 designates generally a carriage for the plate 37 and the carriage is equipped with a ball (not shown) for mating with the screw 50 so that as the screw 50 is turned, the carriage 51 is advanced or retracted, as the case may be.

Vertical Displacement Mechanism

The carriage 51 is further equipped with internal balls for cooperation with a vertically extending screw 52—see also the central left hand portion of FIG. 2. In an analagous fashion, a servo motor 53 is coupled by a timing belt 54 (see FIG. 2) to the screw 52 and controlled by programmable controller MSC-800 referred to above.

Pivotal Displacement Mechanism

Pivoting motion is achieved through an air cylinder 55—see the extreme right central portion of FIG. 1. This is shown in connection with the plate 38 because of the limited space available in the showing relative to the plate 37. However, it will be understood that a similar mechanism is employed relative to plate 37. The air cylinder 55 is connected by means of a linkage 56 to a pivot shaft 57 which is also seen in the left central portion of FIG. 1. The pivot shaft 57 and the air cylinder 55 are also supported on the carriage 51. This is achieved through the provision of a bracket 58 which in turn is secured to the carriage 51 by means of angle clips 59 (see FIG. 2).

Support for the carriage is provided in the form of a hardened shaft way 60. This way 60 is supported from the frame F by brackets 61—see the lower portion of FIG. 2. The carriage is equipped with blocks 62 in which are provided linear bushing 63—see the left central portion of FIG. 1.

The air cylinder which is responsible for the pivotal movement of the plate 37 is controlled by the MSC-800 programmable controller earlier referred to, and is equipped with a suitable solenoid valve for delivering an air pressure signal to the cylinder 55 by flexible conduit (now shown).

The frame is also equipped with another servo motor arranged to operate a screw (not shown) for reciprocating the elevator 34 and pusher 36.

While in the foregoing specification a detailed description of an embodiment of the invention has been set down for the purpose of illustration, many variations in the details hereingiven may be made by those skilled in the art without departing from the spirit and scope of the invention.

I claim:

1. A method for developing stacks of zig-zag folded web segments comprising:

perforating a continuous web at equally longitudinally spaced transverse lines, zig-zag folding said web along said lines and delivering said web into a stacking path having stack elevator means, said path having opposite sides defined by said lines of fold-perforation, providing first and second movable substacks supporting plates, one on each side of said path, moving said first plate completely across said path to sever said web into a completed stack below said first plate and a developing stack above said first plate and supported thereon, transferring the support of said developing substack from said first plate to said elevator means, moving said second plate partially across said path to define a first substack therebelow and a developing second substack thereabove and while said first substack is supported against concavity, moving said first plate partially across said path to define a completed substack therebelow and a third developing substack thereabove and while said second substack is supported against concavity, thereafter removing said second plate from said path to transfer support of two accumulated substacks to said elevator means, cyclically repeating the movement of said plates partway through said path until a predetermined number of substacks has been accumulated with each substack being supported in turn against concavity, and finally moving said first plate completely across said path to sever said web into a completed stack.

2. The method of claim 1 wherein each substack includes 100 panels.

3. The method of claim 1 wherein each stack has up to 4000 panels and being made up of an even number of substacks.

4. In apparatus for zig-zag folding a series of web segments along transverse lines of perforation between said segments and for separating a pre-determined series of said segments into stacks, a frame, co-acting folding rolls mounted on said frame and adapted to deliver a zig-zag folded web along a stack-forming path, a pair of opposed cantilevered plates movably mounted on said frame to provide alternative support for a developing stack to prevent concavity, means on said frame for moving said plates and further means on said frame for removing said stacks from said path, said plate moving means being operative to move a first of said plates completely across said path to sever said web along a predetermined line of perforation, said plate moving means being operative to move the second of said plates only partway across said path whereby said second plate is adapted only to support a developing stack but not to sever said web.

5. The apparatus of claim 1 in which said plate moving means includes a controller for programming the movements of said first plate to cyclically support a predetermined number of substacks before severing said web.

6. Apparatus for zig-zag folding a series of web segments at transverse lines of perforation between said segments and for separating a predetermined series of said segments into a substack for subsequent accumulation into full count stacks, comprising: a frame, co-acting folding rolls mounted on said frames, each with alternating grippers and tuckers which co-act with tuckers and grippers respectively on the other of said co-acting roll, a pair of opposed cantilevered substack support plates which provide substantial support at a number of vertically spaced points to prevent concave curvature of a substack having horizontally disposed segments, each of said support plates being pivotable to separate and movable to independently support a substack while lowering same; control means on said frame for pivoting and moving said plates, one of said support plates being horizontally movable a greater distance than the other and having a cantilevered beveled edge to sever the transverse perforation between alternate substacks, a vertically movable stack support elevator, and means to push a completed stack from said elevator support.

7. The apparatus of claim 6 wherein said control means is operative to provide initial separation between substacks by rapid pivotable insertion of the cantilevered free end of each of said opposing support plates into the path of movement of the perforated folded substack edge.

8. The apparatus of claim 7 wherein said frame is equipped with means for positioning the pivot axis of said plates adjacent to and parallel with the spaced fold lines between consecutive forms.

* * * * *